US005906551A

United States Patent [19]

Kasashima et al.

[11] Patent Number: 5,906,551

[45] Date of Patent: May 25, 1999

[54] GOLF BALL

[75] Inventors: Atsuki Kasashima; Keisuke Ihara; Hirotaka Shimosaka; Yutaka Masutani; Michio Inoue, all of Chichibu, Japan

[73] Assignee: Bridgestone Sports Co., Ltd., Tokyo, Japan

[21] Appl. No.: 08/954,085

[22] Filed: Oct. 20, 1997

[30] Foreign Application Priority Data

Oct. 28, 1996 [JP] Japan ..... 8-302471

[51] Int. Cl.[6] ..... A63B 37/14

[52] U.S. Cl. ..... 473/384; 473/382

[58] Field of Search ..... 473/383, 384

[56] References Cited

U.S. PATENT DOCUMENTS

| | | | |
|---|---|---|---|
| 5,090,705 | 2/1992 | Oka et al. | 473/384 |
| 5,190,294 | 3/1993 | Oka | 473/383 |
| 5,192,078 | 3/1993 | Woo | 473/383 X |

*Primary Examiner*—George J. Marlo

*Attorney, Agent, or Firm*—Sughrue, Mion, Zinn, Macpeak & Seas, PLLC

[57] ABSTRACT

In a golf ball having a parting line formed at the junction between a pair of mold sections and a plurality of dimples some of which lie across the parting line and being free of a great circle which does not intersect with the dimples, the crossing dimples lying across the parting line have a greater edge angle than those dimples of the same diameter as the crossing dimples disposed near the poles. The ball is improved in symmetry in that the flight distance is substantially equal between seam hitting and pole hitting.

12 Claims, 2 Drawing Sheets

POLE HITTING

POLE HITTING

SEAM HITTING

GOLF BALL

BACKGROUND OF THE INVENTION

1. Field of the Invention

This invention relates to a dimpled golf ball free of a great circle which does not intersect with the dimples and having high symmetry.

2. Prior Art

The flying performance of golf balls is greatly affected by the arrangement and configuration (including diameter, depth and cross-sectional shape) of the dimples. Various dimple arrangements are known in the art for arranging a plurality of dimples on the ball surface in an even or dense fashion. Typical known dimple arrangements are regular polyhedral arrangements. It is also known to equally divide the hemisphere into one to six sections, especially three to six sections from its center.

It is attempted in JP-B 7875/1994 corresponding to U.S. Pat. No. 4,744,564, to tailor the dimple configuration such that the overall effective volume of dimples remains substantially equal between pole hitting (the spin axis is in the equator plane) and seam hitting (the spin axis is a pole-to-pole line).

Golf balls are generally molded in an axisymmetric manner by using a mold comprising a pair of mold halves removably mating the mold halves along a parting line to define a spherical cavity therein, and introducing stock material into the cavity. The golf balls thus molded tend to have a higher degree of roundness or sphericity about a pole-to-pole axis corresponding to a line connecting the apexes of the mold half cavities, but a lower degree of roundness about an axis on a plane circumscribed by a seam line corresponding to the parting plane of the mold. Because of such roundness variation, conventional golf balls exhibit different flight performance depending on the position at which the ball is hit. Such flight performance variation raises a serious problem in the game of golf wherein the Rules of Golf prescribe that "the ball shall be played as it lies, except as otherwise provided in the Rules."

More specifically, when a golf ball is hit by a club, the ball is given back spin although the number of revolutions varies with a particular type of club. The hitting of a ball is generally classified into pole hitting and seam hitting depending on an impact point. Reference is now made to FIGS. 2(A) and 2(B) wherein a golf ball 11 has a great circle or seam line 12 and a center 16. The pole hitting means that the ball 11 is hit at arrow 20 to give back spin about a straight line 18 connecting two diametrically opposed points 14, 14 on the seam line 12 and the center 16 as shown in FIG. 2(A). Seam hitting means that the ball 11 is hit at arrow 26 to give back spin about a straight line 24 extending perpendicular to a circular plane 22 circumscribed by the seam line 12 and passing the center 16. As previously mentioned, in the event of pole hitting shown in FIG. 2(A), the ball is susceptible to extra lift or drag since it does not define a true circle about the spin axis 18. On the other hand, in the event of seam hitting shown in FIG. 2(B), the ball is substantially free of extra lift or drag since it is close to a true circle about the spin axis 24. As a consequence, if the ball is simply designed such that the effect of dimples themselves may be equal between pole hitting and seam hitting, the effect of dimples would be greater on pole hitting because of a deviation from roundness. Then, upon pole hitting, the golf ball receives extra lift or drag, exhibiting different flight performance than upon seam hitting. This means that the flight performance varies with a particular hit position.

To produce a golf ball which is improved in symmetry in that the flight performance remains constant regardless of a particular hit position, the arrangement and configuration of dimples must be designed in consideration of the shape or roundness of the ball to optimize the effect of dimples. This requirement has not been fully satisfied.

SUMMARY OF THE INVENTION

Therefore, an object of the present invention is to provide a golf ball which is improved in symmetry in that the ball will follow the same trajectory on either seam hitting or pole hitting, that is, the flight performance does not vary with a particular hit position.

The present invention is directed to a golf ball prepared by molding in a mold comprising a pair of mold sections which are removably mated to define a spherical cavity therein. The golf ball has a parting, lie formed at the junction between the mold sections and a plurality of dimples some of which lie across the parting line. The golf ball is free of a great circle which does not intersect with the dimples. The ball has poles diametrically opposed with respect to the parting line. According to the invention, the crossing dimples lying across the parting line have a greater edge angle than those dimples having the same diameter as the crossing dimples any disposed near the poles.

There are known many golf balls having dimples lying across the parting line and free of a great circle which does not intersect with the dimples. These golf balls are believed to have greater symmetry than those golf balls free of dimples lying across the parting line. However, the inventors further study revealed that a golf ball provided with dimples lying across the parting line still had insufficient symmetry in that the flight distance fairly varied between seam hitting and pole hitting. The inventors have found that when the edge angle of the dimples lying across the parting line is made greater than that of the dimples of the same diameter disposed near the poles, preferably by at least 2 degrees, more preferably by 2 to 10 degrees, quite unexpectedly, the ball is so improved in symmetry that a substantially equal flight distance is obtained between seam hitting and pole hitting. It is noted that the dimples disposed near the poles are those dimples whose center is located at a latitude of 30 degrees or more, assumed that the parting line is an equator line (latitude zero).

The reason why such an improvement in symmetry is achieved is not well understood. A golf ball as molded in a mold comprising a pair of mold halves has burrs at the parting line or the junction between the mold halves. Then the molded golf ball is generally subject to polishing known as trimming for removing the burrs at the parting line. The geometry of those dimples lying across the parting line as trimmed is different from the geometry as molded. This geometrical change of those dimples lying across the parting line is subsequently followed by subsequent painting. It would be presumed that this improvement is correlated to the geometrical change of dimples and lands introduced by trimming and painting. This presumption, however, is uncertain because the feature of the invention that the crossing dimples lying across the parting line have a greater edge angle than those dimples of the same diameter disposed near the poles is for a golf ball as a final product after trimming and painting. Also, this invention is distinguished from the concept that the mold design is made such that the edge angle of the crossing dimples lying across the parting line is greater at the end of molding, and that edge angle is reduced by subsequent trimming and painting to be substantially equal to the edge angle of those dimples of the same diameter disposed near the poles.

BRIEF DESCRIPTION OF THE DRAWINGS

These and further features of the present invention will be apparent with reference to the following description and drawings, wherein.

DETAILED DESCRIPTION OF THE INVENTION

The golf ball of the invention has a plurality of dimples indented in its spherical surface. The golf ball is free of a great circle which does not intersect with the dimples. The golf ball is prepared by molding a stock material in a mold comprising a pair of mold sections which are removably mated to define a spherical cavity therein. A parting line is thus formed on the golf ball at the junction between the mold sections. Some of the dimples lie across the parting line and these dimples are designated crossing dimples D1, hereinafter. There is not a great circle which does not intersect with the dimples. It is understood that the line which does not intersect with a dimple is a line which does not traverse a dimple. In this sense, the dimple which is tangent to the great circle is considered a dimple which does not intersect with the great circle. Poles are diametrically opposed on the spherical surface of the ball with respect to the parting line.

Well-known methods may be used to form the crossing dimples D1 on the parting line. It is convenient to use a mold wherein dimple-forming pins are disposed in one or both of the parting surfaces of upper and lower mold sections.

A golf ball is molded as mentioned above and then trimmed and painted by conventional well-known methods. There is obtained a golf ball as a final product. In the golf ball as a final product according to the invention, the edge angle of the crossing dimples D1 lying across the parting line is greater than the edge angle of those dimples D2 which have the same diameter as the crossing dimples and are disposed near the poles, preferably by at least 2 degrees, more preferably by 2 to 10 degrees, most preferably by 2 to 5 degrees.

Figure 1:
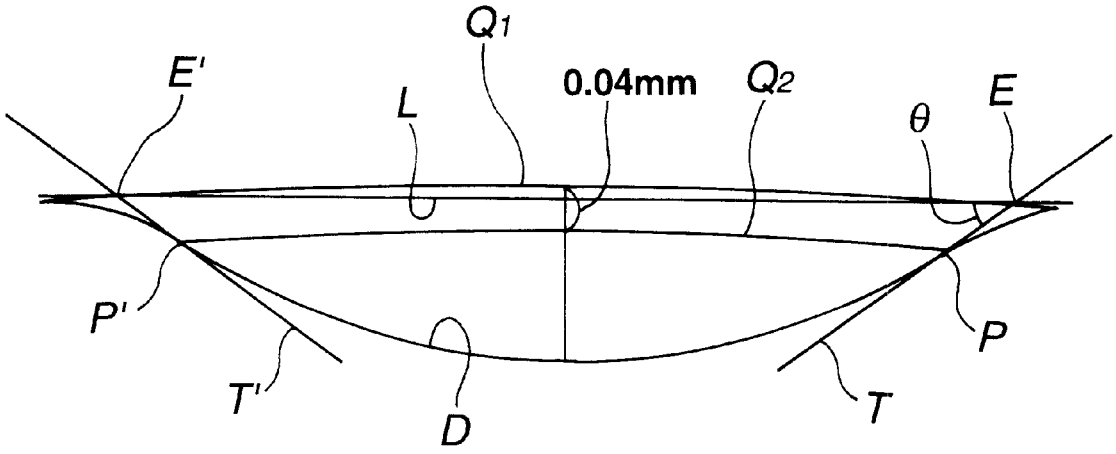
FIG. 1 is a cross-sectional view of a dimple, illustrating the definition of an edge angle thereof.

The edge angle is defined as follows. Referring to FIG. 1, a dimple D is shown in cross section. With respect to the center of the golf ball (not shown), a phantom first spherical surface Q1 of the golf ball prior to the formation of the dimple (that is, the spherical surface of a dimple-free golf ball) is depicted. Then depicted is a phantom second spherical surface Q2 having a radius which is 0.04 mm smaller than the radius of the first spherical surface Q1. The second spherical surface Q2 intersects with the surface of the dimple D at points P and P' where tangent lines T and T' are depicted. The tangent lines T and T' intersect with the first spherical surface Q1 at points E and E', which are edges of the dimple D. The angle θ between a line segment L joining points E and E' and the tangent line T or T' is an edge angle. The distance between points E and E' is the diameter of the dimple D. The distance between the bottom center of the dimple and the line segment L is the depth of the dimple.

The crossing dimples D1 lying across the parting line preferably have an edge angle θ of 5 to 30 degrees, more preferably 8 to 25 degrees whereas dimples disposed near the poles including the dimples D2 of the same diameter as the dimples D1 preferably have an edge angle θ of 3 to 25 degrees, more preferably 6 to 15 degrees.

No particular limits are imposed on the diameter and depth of dimples whether or not they are the crossing dimples D1 lying across the parting line. Preferably, the dimples disposed near the poles have a diameter of 2 to 5 mm, especially 2.4 to 4.5 mm and a depth of 0.05 to 0.3 mm; and the crossing dimples D1 lying across the parting line have a diameter of 2 to 4.5 mm and a depth of 0.12 to 0.30 mm.

Also preferably, the number of the crossing dimples D1 lying across the parting line is 6 to 20, especially 6 to 15. The improvement in symmetry would be insufficient if the number of the crossing dimples is smaller. If the number of the crossing dimples is larger, a larger number of dimple-forming pins must be received in a corresponding number of grooves which are drilled in the mold sections. Then the mold sections would become weak near the parting surface.

In the golf ball of the invention, the overall number of dimples is generally 240 to 620, preferably 318 to 500. Most often, the planar shape of dimples is circular. The dimples may be of one type having an identical diameter and depth or of two or more types which are different in diameter and/or depth. It is preferred to distribute dimples of two to five types, especially two to four types having different diameters. The pattern of dimple arrangement may be selected from various patterns, for example, regular octahedral, dodecahedral and icosahedral arrangements.

Insofar as the dimples satisfy the above-mentioned requirement, the golf ball of the invention may have any desired structure. The invention is applicable to solid golf balls including one-piece golf balls, two-piece golf balls, and multi-piece golf balls of three or more layer structure as well as wound golf balls. These golf balls can be prepared from well-known stock materials by conventional methods. The diameter and weight of the golf ball may be properly determined in accordance with the Rules of Golf.

EXAMPLE

Examples of the invention are given below by way of illustration and not by way of limitation.

Examples 1–4 and Comparative Examples 1–4

On two-piece solid golf balls of the large size (diameter 42.67 mm and weight 45.2 grams), circular dimples were arranged in a number shown in Table 2.

In Example 1 and Comparative Example 1, the balls had dimples with a diameter of 3.8 mm and a depth of 0.17 mm and twelve (12) dimples lying across the parting line. The edge angle of dimples is shown in Table 1. The dimples are distributed in a regular octahedral arrangement.

In Example 2 and Comparative Example 2, the balls had dimples with a diameter of 3.6 mm and a depth of 0.163 mm and twelve (12) dimples lying across the parting line. The edge angle of dimples is shown in Table 1. The dimples are distributed in a regular icosahedral arrangement.

The arrangement of dimples on the balls of Examples 3–4 and Comparative Examples 3–4 is shown below.

Example 3 and Comparative Example 3

| | | | |
|---|---|---|---|
| Total number of dimples: | 462 | | |
| Type of dimples: | 4 | | |
| Diameter | 2.3 mm | Depth | 0.12 mm |
| | 3.2 mm | | 0.14 mm |
| | 3.4 mm | | 0.15 mm |
| | 3.7 mm | | 0.17 mm |
| Dimple arrangement: | icosahedral | | |

Example 4 and Comparative Example 4

| | | | |
|---|---|---|---|
| Total number of dimples: | 406 | | |
| Type of dimples: | 2 | | |
| Diameter | 3.0 mm | Depth | 0.135 mm |
| | 3.7 mm | | 0.165 mm |
| Dimple arrangement: | octahedral | | |

It is noted that D1 designates those dimples lying across the parting line and D2 designates those dimples of the same diameter as the crossing dimples D1 disposed near the poles.

Figure 2A:
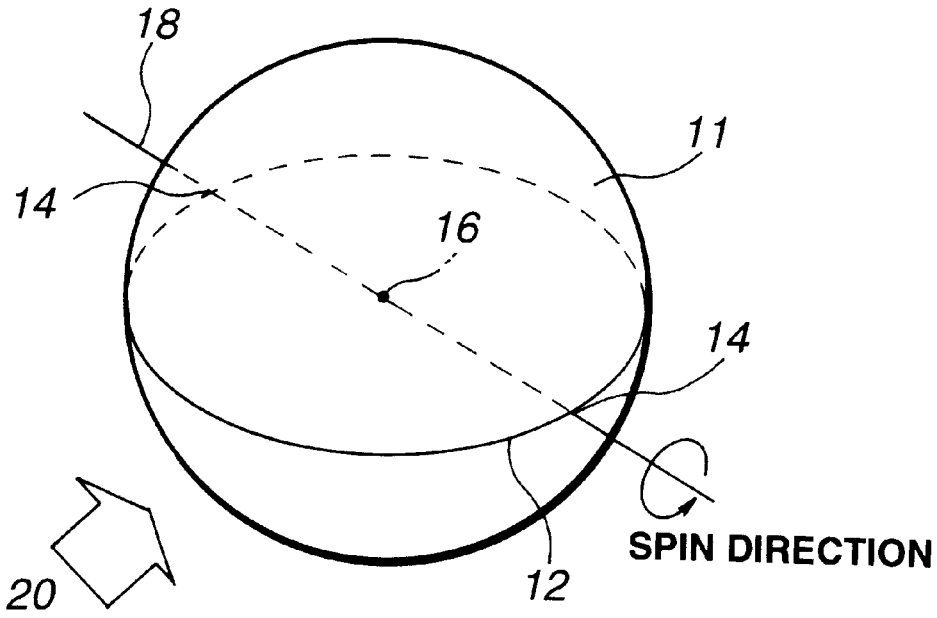
FIG. 2 illustrates the direction in which a golf ball is hit by a club, FIG. 2(A) corresponding to pole hitting and FIG. 2(B) corresponding to seam hitting.
Figure 2B:
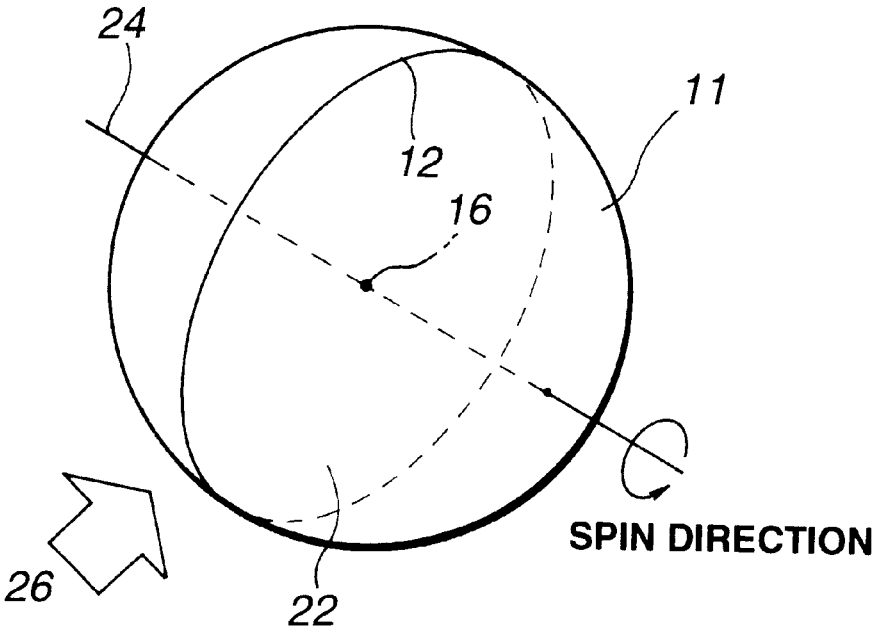

The golf balls were tested by means of a swing robot using a driver (#W1) as a club. The balls were repeatedly hit at a head speed of 45 m/sec. by pole hitting (in the hitting direction shown in FIG. 2(A)) and seam hitting (in the hitting direction shown in FIG. 2(B)). The carry and total distance (both expressed in meter) were measured for evaluating symmetry. The results are shown in Table 2.

TABLE 1

| | Number of dimples D1 | Edge angle of dimples D1 (°) | Edge angle of dimples D2 (°) |
|---|---|---|---|
| E1 | 12 | 9.5 | 7.0 |
| E2 | 12 | 11.3 | 8.2 |
| E3 | 12 | 25.5 | 20 |
| E4 | 6 | 15.2 | 12 |
| CE1 | 12 | 7.0 | 7.0 |
| CE2 | 12 | 8.2 | 8.2 |
| CE3 | 12 | 20 | 20 |
| CE4 | 6 | 12 | 12 |

TABLE 2

| | Total number of dimples | hitting direction | carry (m) | Total (m) | Symmetry |
|---|---|---|---|---|---|
| E1 | 380 | seam hitting | 212.5 | 225.0 | good |
| | | pole hitting | 212.0 | 224.0 | |
| E2 | 420 | seam hitting | 211.0 | 224.5 | good |
| | | pole hitting | 211.5 | 224.0 | |
| E3 | 406 | seam hitting | 210.0 | 228.0 | good |
| | | pole hitting | 210.0 | 227.5 | |
| E4 | 462 | seam hitting | 213.0 | 227.0 | good |
| | | pole hitting | 212.0 | 227.5 | |
| CE1 | 380 | seam hitting | 209.5 | 221.0 | poor |
| | | pole hitting | 213.0 | 225.0 | |
| CE2 | 420 | seam hitting | 208.5 | 222.0 | poor |
| | | pole hitting | 212.0 | 225.0 | |
| CE3 | 406 | seam hitting | 206.5 | 225.0 | poor |
| | | pole hitting | 209.0 | 228.5 | |
| CE4 | 462 | seam hitting | 209.5 | 225.5 | poor |
| | | pole hitting | 212.5 | 228.5 | |

There has been described a golf ball wherein the dimples lying across the parting line have a greater edge angle than those dimples of the same diameter disposed near the poles whereby the ball is improved in symmetry in that the flight distance is substantially equal between seam hitting and pole hitting.

Although some preferred embodiments have been described, many modifications and variations may be made thereto in the light of the above teachings. It is therefore to be understood that within the scope of the appended claims, the invention may be practiced otherwise than as specifically described.

We claim:

1. In a golf ball prepared by molding in a mold comprising a pair of mold sections which are removably mated to define a spherical cavity therein, the golf ball having a parting line formed at the junction between the mold sections and a plurality of dimples some of which lie across the parting line and being free of a great circle which does not intersect with some dimples, said ball having poles diametrically opposed with respect to the parting line, the improvement wherein said crossing dimples lying across the parting line have a greater edge angle than those dimples of the same diameter as said crossing dimples and disposed near the poles.

2. The golf ball of claim 1 wherein the number of said crossing dimples lying across the parting line is 6 to 20.

3. The golf ball of claim 1 wherein said crossing dimples lying across the parting line have a diameter of 2 to 4.5 mm.

4. The golf ball of claim 3, wherein said crossing dimples have a depth in the range of 0.12 to 0.30 mm.

5. The golf ball of claim 1 wherein said crossing dimples lying across the parting line have structural characteristics corresponding to those resulting from being shaped by dimple-forming pins which are disposed in either one of the mold sections or the junction therebetween.

6. The golf ball of claim 1, wherein said crossing dimples lying across said parting line have an edge angle of 5 to 30 degrees.

7. The golf ball of claim 6, wherein dimples disposed near the poles have an edge diameter of 3 to 25 degrees.

8. The golf ball of claim 1, wherein said dimples disposed near said poles have a diameter in the range of 2.4 to 4.5 mm and a depth in the range of 0.05 to 0.3 mm.

9. The golf ball of claim 1, wherein the total number of said dimples is in the range of 240 to 620.

10. The golf ball of claim 9, wherein said dimples comprise two to four types having different diameters.

11. The golf ball of claim 1, wherein said crossing dimples have an edge angle at least 2 degrees greater than dimples having the same diameter and disposes near the poles.

12. The golf ball of claim 1, wherein said crossing dimples have an edge angle in the range of 2 to 10 degrees greater than dimples on the same diameter disposed near the poles.

* * * * *